United States Patent [19]

Allred

[11] Patent Number: 4,762,285

[45] Date of Patent: Aug. 9, 1988

[54] BOBBIN WINDER FOR A SPINNING WHEEL

[76] Inventor: Mark Allred, Box 24, Afton, Wyo. 83110

[21] Appl. No.: 42,843

[22] Filed: Apr. 27, 1987

[51] Int. Cl.[4] ..... B65H 54/00; B65H 54/56

[52] U.S. Cl. ..... 242/47; 57/316

[58] Field of Search ..... 242/47, 1, 18 R, 53; 57/316

[56] References Cited

U.S. PATENT DOCUMENTS

| | | | |
|---|---|---|---|
| 5,847 | 10/1848 | Shaw . | |
| 14,482 | 3/1856 | Wigrt . | |
| 42,661 | 5/1864 | Hotchkiss | 57/316 |
| 58,015 | 9/1866 | Wilson et al. | 57/316 |
| 227,873 | 5/1880 | Allen | 57/316 |
| 259,380 | 6/1882 | Gaines | 57/316 |
| 325,368 | 9/1885 | Tubbs . | |
| 355,870 | 1/1887 | Good . | |
| 419,569 | 1/1890 | Sullivan . | |
| 467,654 | 1/1892 | Lotz . | |
| 580,452 | 4/1897 | Engel . | |
| 710,459 | 10/1902 | Horlacher . | |
| 852,356 | 4/1907 | Stevenson . | |
| 1,562,924 | 11/1925 | Stell . | |
| 2,538,189 | 1/1951 | Caron | 57/316 |
| 4,348,860 | 9/1982 | Hartmannsgruber . | |
| 4,445,324 | 5/1984 | Watkinson . | |
| 4,458,474 | 7/1984 | Lee . | |

*Primary Examiner*—Stanley N. Gilreath

*Attorney, Agent, or Firm*—Hill, Van Santen, Steadman & Simpson

[57] ABSTRACT

A bobbin winder which can be mounted in the flyer bearings and can be driven by the belt of the spinning wheel and upon which a bobbin spool may be mounted so as to wind thread or yarn by using the drive of the spinning wheel.

2 Claims, 1 Drawing Sheet

BOBBIN WINDER FOR A SPINNING WHEEL

BACKGROUND OF THE INVENTION

1. Field of the Invention

This invention relates in general to spinning wheels and in particular to a novel binding winder which can be mounted on a spinning wheel.

2. Description of the Prior Art

Bobbin winders are known which include a base, a crank and a drive gear, a driven gear and a spindle. See also U.S. Pat. Nos. 5,847, 14,482, 42,661, 325,368, 355,870, 419,569, 467,654, 580,452, 710,459, 852,356, 1,562,924, 2,245,359, 4,348,860, 4,445,324, 4,458,474.

SUMMARY OF THE INVENTION

The present invention comprises a bobbin winder which can be mounted in the flyer support bearings on a spinning wheel and is driven by the belt of the spinning wheel. The bobbin winder has a shaft with a bearing surface and a long tapered spindle. It also has a pulley assembly which consists of a belt groove, a set screw and a second bearing surface. The spindle is tapered so that a bobbin spool may be firmly placed on the spindle. The long taper makes it possible to use spools with holes of various sizes and it is designed to fit most spools presently being used.

The bobbin winder is fitted to the spinning wheel after removing the flyer from its support bearings and placing the bobbin winder in its place using the same support bearings. After the first bearing surface is in position, the pulley assembly is adjusted so that the second bearing surface is the proper distance from the first bearing surface in the flyer bearing. The belt is used as the cord to drive the bobbin winder in the same manner that the flyer is driven.

Thus, the present invention allows the mechanism of the spinning wheel to be utilized to drive a bobbin winder which can be quickly mounted on the spinning wheel.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
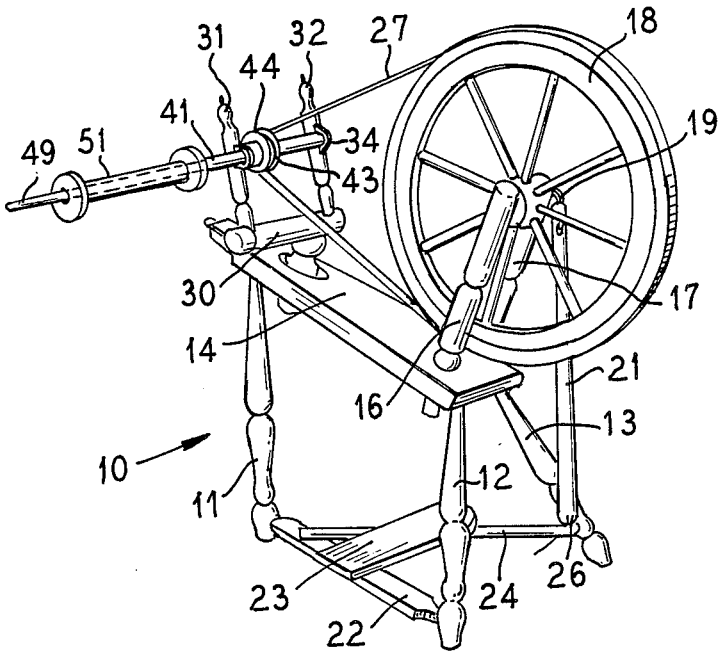
FIG. 1 is a perspective view of the spinning wheel-bobbin winder of the invention.

FIG. 1 illustrates a spinning wheel 10 which has support legs 11, 12 and 13 to which a platform 14 is attached. A pair of wheel supports 16 and 17 extend upwardly from the platform 14 and rotatably support the wheel 18. A crank arm 19 is connected to the wheel 18 and connects to a drive rod 21 which has its lower end 26 pivotally connected to a shaft 24 which is connected to a treadle plate 23 carried on a pivoted bar 22 pivotably supported in the legs 11 and 12.

Figure 2:
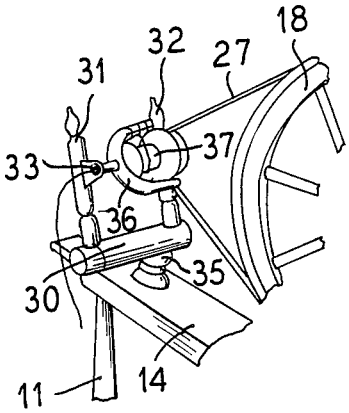
FIG. 2 is a partially cut-away view illustrating the flyer mounted on the spinning wheel.
Figure 4:
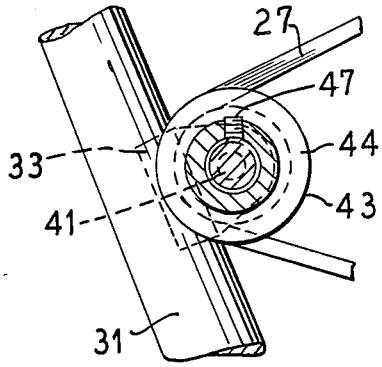
FIG. 4 is a sectional view showing the bobbin winder.
Figure 3:
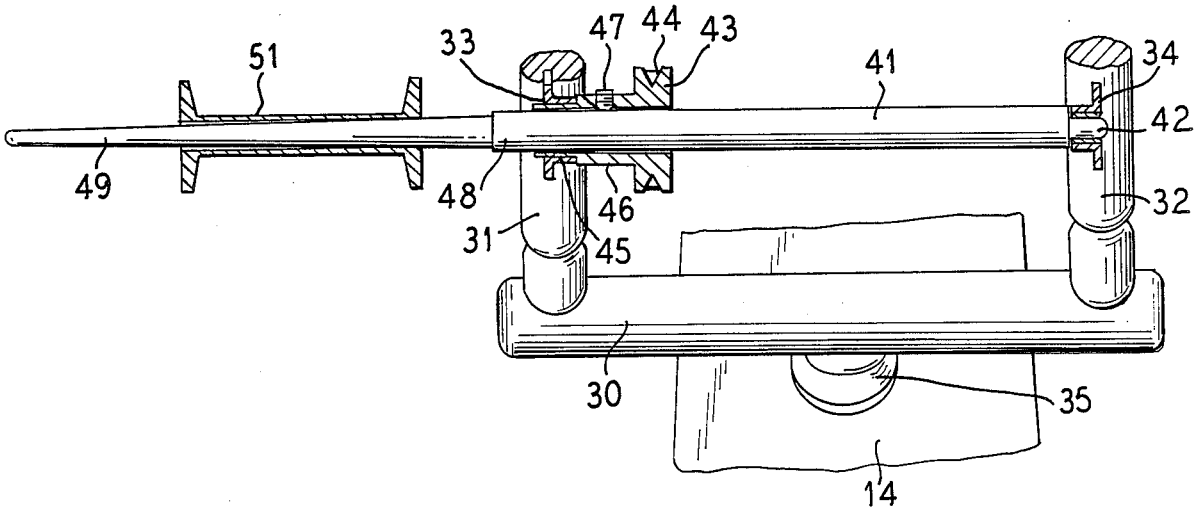
FIG. 3 is a sectional view through the bobbin winder illustrating how its mounted on the spinning wheel.

A belt 27 is carried on the rim of the spinning wheel 18 and normally drives a flyer 36 and a spool 37 as shown in FIG. 2. A pair of uprights 31 and 32 are supported as shown in FIGS. 1, 2 and 3 by a support 35 from the platform 14. The upright 32 has a bearing 34 and the upright 31 has a bearing 33. The spool 37 is rotatably supported in the bearing 34 and the flyer is rotatably supported in the bearing 33.

The flyer 36 and the spool 37 can be removed from the spinning wheel and the bobbin winder 41 of the invention can be mounted in the bearings 33 and 34. The bobbin winder 41 consists of a shaft which has a first bearing surface 42 that is receivable in the bearing 34 as shown in FIG. 3. A pulley assembly 43 fits about the shaft 41 of the bobbin winder and a set screw 47 can be loosened to allow adjustment of the position of the pulley 43 on the shaft 41. The pulley 43 has a bearing surface 45 which may be of metal so as to provide a firm bearing surface which will not wear which is inserted through the bearing 33 and the set screw 47 may be tighened to position the pulley 43 on the shaft 41. It is to be noted that the collar 46 of the pulley 43 is adjusted so it bears against the bearing 33, thus, locking the end 42 of the shaft 41 in the bearing 34. The shaft 41 has a fixed diameter portion 48 as shown.

The outer end 49 of the bobbin winder 41 is tapered so that bobbin spools 51 having different size openings therein can be mounted thereon. After the bobbin winder 41 has been mounted in the spinning wheel as shown in FIG. 3, the belt 27 is placed into the V-shaped groove 44 of the pulley 43 such that when the treadle 23 is operated, the wheel 18 will be turned driving the belt 27 which will in turn drive the bobbin winder 41 and the bobbin spool 51 so that thread or yarn can be wound on the spool 51.

It is seen that the present invention allows a spinning wheel to be utilized as a bobbin winder by using the treadle and wheel belt drive of the spinning wheel to drive the bobbin winder.

Although the invention has been described with respect to preferred embodiments, it is not to be so limited as changes and modifications may be made therein which are within the full intended scope of the invention as defined by the appended claims.

I claim as my invention:

1. A winding apparatus comprising, a frame, a drive wheel with a crank arm rotatably supported by said frame, a treadle pivotally attached to said frame and coupled to said crank arm of said drive wheel, a pair of spaced uprights mounted on said frame and each with first and second bearing elements respectively mounted thereon, a shaft with a reduced end bearing portion which cooperates with said first bearing element in one of said pair of spaced uprights, a pulley with a collar positioned on said shaft with its bearing portion extending into said second bearing element in a second one of said pair of uprights, means for locking said pulley and collar to said shaft at a position which prevents the shaft from shifting position relative to said pair of uprights and said shaft having an extended tapered portion which extends beyond said second upright, a drive belt mounted on said pulley and said drive wheel so that said shaft is rotated when said drive wheel is rotated by said treadle; and a bobbin spool with an opening mounted on said extended tapered portion of said shaft and said extended portion is tapered so as to receive spools having openings of different sizes.

2. A bobbin winder according to claim 1 wherein said bearing portion of said pulley is a metal cylindrical portion.

* * * * *